United States Patent [19]

Beard et al.

[11] 4,164,942

[45] Aug. 21, 1979

[54] FACE MASK AND FACEPIECE THEREFOR

[75] Inventors: Michael A. Beard, Moseley; Edward A. Williams, Warwick, both of England

[73] Assignee: DCA Design Consultants Limited, Warwick, England

[21] Appl. No.: 835,007

[22] Filed: Sep. 20, 1977

[30] Foreign Application Priority Data

Sep. 21, 1976 [GB] United Kingdom ..... 39043/76

[51] Int. Cl.[2] ..... A62B 7/14

[52] U.S. Cl. ..... 128/146.5

[58] Field of Search ..... 128/141 R, 141 A, 142 R, 128/142.2, 142.3, 142.4, 142.5, 142.6, 142.7, 145 R, 146, 146.3, 146.4, 146.5, 146.6, 146.7, 205, 211, 191 R

[56] References Cited

U.S. PATENT DOCUMENTS

| | | | |
|---|---|---|---|
| 731,973 | 6/1903 | Teter | 128/205 |
| 2,039,234 | 4/1936 | Malcom | 128/142.4 |
| 2,444,417 | 7/1948 | Bierman | 128/146.4 |
| 3,056,402 | 10/1962 | Dickinson | 128/146.7 |

FOREIGN PATENT DOCUMENTS

| | | | |
|---|---|---|---|
| 497671 | 5/1930 | Fed. Rep. of Germany | 128/141 R |

*Primary Examiner*—Henry J. Recla

*Attorney, Agent, or Firm*—Irving M. Weiner; Pamela S. Austin; Melvin Yedlin

[57] ABSTRACT

A face mask comprising a substantially planar valve block having a first aperture therethrough containing an inspiratory valve and a second aperture therethrough containing an expiratory valve. The face mask also includes a support member, and a facepiece comprising a flexible, molded member having a substantially planar face of substantially constant thickness and with two apertures therein aligned with the first and second apertures of the valve block. The substantially planar face acts as a gasket between the valve block and the support member.

5 Claims, 3 Drawing Figures

FACE MASK AND FACEPIECE THEREFOR

BACKGROUND OF THE INVENTION

1. Field of the Invention

The present invention relates to a face mask, particularly, but not exclusively, to an aircrew oxygen mask, and a facepiece therefor.

2. Description of the Prior Art

In a well-known aircrew oxygen mask, valves are mounted within a complex face-seal molding, and the whole mask must be stripped down to carry out valve replacement. The problem of frequent face-seal replacement has been somewhat alleviated by the use of silicone rubber in place of natural rubber, but the complexity of the face-seal moulding still makes the continued use of this kind of mask extremely expensive. Furthermore, the very complex molds producing the face-seal molding are extremely expensive to replace.

An object of the present invention is to provide a facepiece which is easier and less expensive to produce than known face-seal moldings, and to provide a face mask incorporating such a facepiece in which valve replacement is comparatively simple.

SUMMARY OF THE INVENTION

The invention provides a facepiece comprising a flexible, molded member having a substantially planar face of substantially constant thickness and with apertures therein for gas flow therethrough.

Preferably, the member is molded from natural or silicon rubber.

The invention further provides a face mask comprising a substantially planar valve block having a first aperture therethrough containing an inspiratory valve and a second aperture therethrough containing an expiratory valve. The face mask further includes a support member, and a facepiece comprising a flexible molded member having a substantially planar face of substantially constant thickness and with two apertures therein aligned with the first and second apertures of the valve block, wherein the substantially planar face acts as a gasket between the valve block and the support member.

Preferably, the valve block has a third aperture therethrough containing an anti-suffocation valve aligned with a third aperture in the substantially planar face.

Further, the support member is preferably in the form of an exo-skeleton having an inlet and an outlet and the valve block is arranged within the confines of the facepiece.

Preferably, a microphone assembly is removably mounted in the exo-skeleton and is aligned with a further aperture in the valve block and a corresponding aperture in the substantially planar face.

In addition, the exo-skeleton preferably carries a removable harness assembly for attaching the face mask to a wearer.

The invention will now be described with reference to an embodiment shown by way of example in the accompanying drawings.

DETAILED DESCRIPTION

Figure 1:
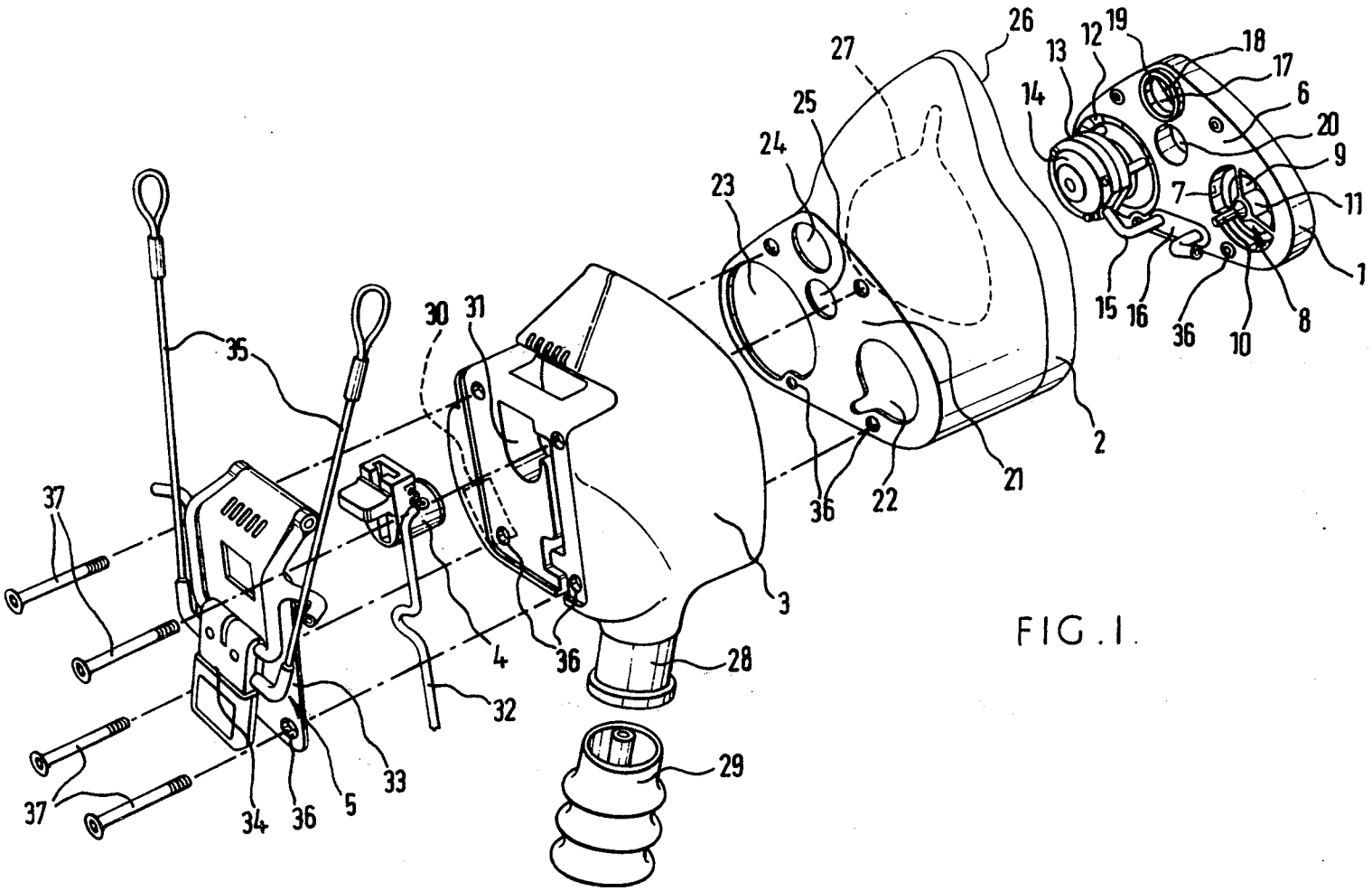
FIG. 1 is an exploded view of the face mask, according to the invention.
Figure 2:
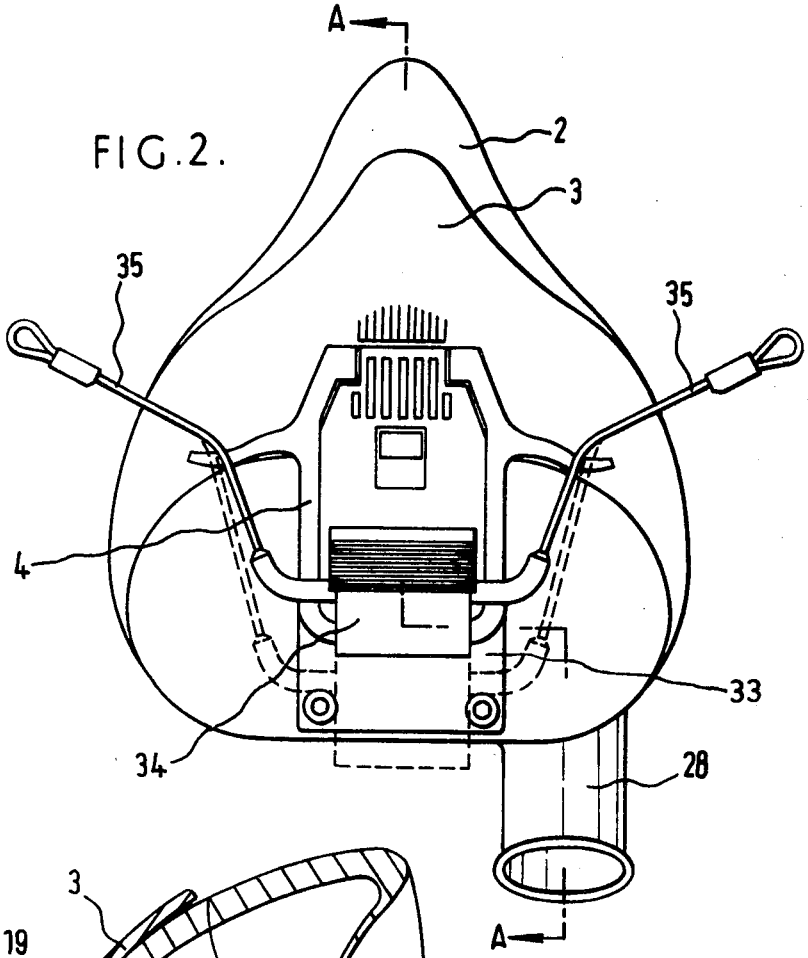
FIG. 2 is a front view of the mask of FIG. 1.

With reference, particularly to FIG. 1, an aircrew oxygen mask comprises essentially a valve block assembly 1, a facepiece 2, an exo-skeleton 3, a microphone and switch assembly 4, and a harness assembly 5.

The valve block assembly 1 comprises a flat plate-shaped valve block 6 having four apertures therethrough. A first aperture 7 has a stepped-rubber inspiratory valve 8 therein. The valve 8 is mounted in a seating molded integrally with the block 6 and comprises a mushroom-shaped petal diaphragm 9, which is retained by an integrally molded knob 10 on a center stem 11 of the diaphragm 9. An ice guard (not shown) may also be provided, e.g., in the form of a molded shield which may be clipped on the valve block 6.

The valve block 6 has a second aperture 12 in which a fully-compensated expiratory valve 13 is mounted. A seating and diaphragm-supporting structure may be molded integrally with the valve block 6. The valve 13 comprises a single clip-in cap end molding 14, a spring and a disc (not shown). A compensating tube 15 for adjusting back pressure is molded as part of the cap molded 14 and is located in a connecting-shaft insert 16 in the valve block 6.

Figure 3:
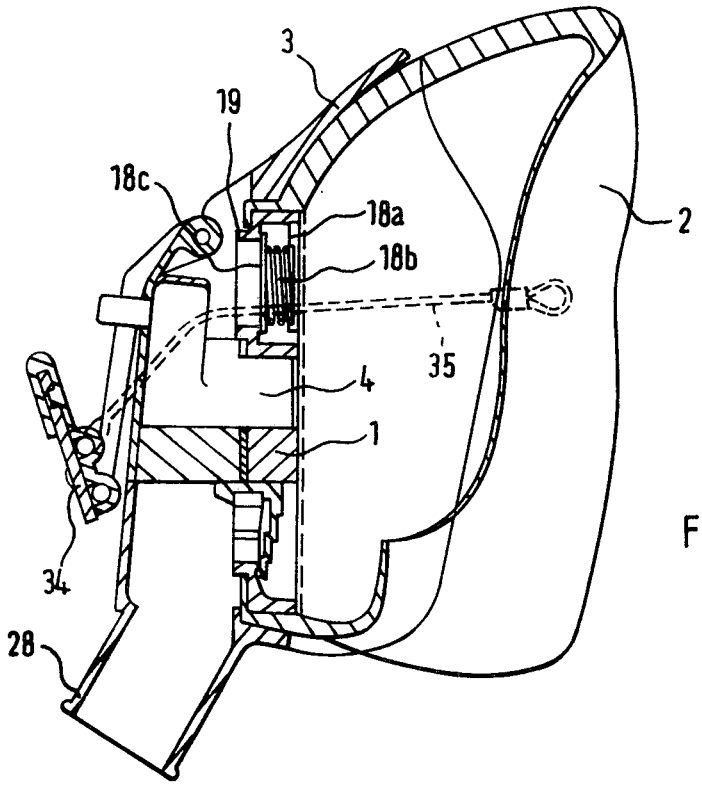
FIG. 3 is a section taken along the line A—A of FIG. 2.

The valve block 6 has a third aperture 17 containing an anti-suffocation valve 18. A seating 19 is molded integrally with the valve block 6 and the valve 18 comprises a cap molding **18*a* clipped into the aperture 17 to retain a spring 18*b* and a disc 18*c* (FIG. 3**).

The valve block 6 has a fourth aperture 20 which allows access to the end of the microphone assembly 4.

The facepiece 2 has a flat gasket face 21 having four apertures 22, 23, 24 and 25 aligned with the apertures 7, 12, 17 and 20, respectively. The facepiece 2 may be formed of any suitable flexible material, e.g. molded from rubber, but preferably silicone rubber. The facepiece 2 has facial contours 26, 27 suitable for a wide range of face sizes and shapes. A nose occlusion strip may be provided within the thickness of the molding. In practice it has been found that it is only necessary to provide two different sizes of facepiece 2.

The exo-skeleton 3 is injection molded from any suitable material and has an air inlet 28, connected to a supply hose 29, and an outlet 30. An aperture 31 through the exo-skeleton 3 is aligned with the aperture 25 of the facepiece 2 and the aperture 20 of the valve block 6, and accommodates the microphone and switch assembly 4. The assembly 4 has a signal cable 32 and is held in place by means of the harness assembly 5.

The harness assembly 5 comprises a support plate 33 to which a toggle plate 34 carrying a flexible steel wire harness 35 is pivotably mounted. The support plate 33, the exo-skeleton 3, the gasket face 21 and the valve block 6 have aligned screw apertures 36 through which screws 37 pass to hold the mask together with valve block 6 secured adjacent the inner surface of gasket face 21 and exo-skeleton 3 secured substantially adjacent the outer surface of gasket face 21. The mask may be very easily dismantled and reassembled for replacement of any of the parts, it being only necessary to remove the harness assembly 5 to gain access to the microphone switch assembly 4, which may be encased in a plastic molding to facilitate handling and assembly.

We claim:

1. A face mask comprising:

a substantially planar valve block having first and second apertures therethrough;

an inspiratory valve arranged in said first aperture;

an expiratory valve arranged in said second aperture;

a substantially flexible molded facepiece having a substantially planar face of substantially constant thickness, said planar face having two apertures therethrough;

said planar valve block being secured adjacent an inner surface of said planar face of said facepiece with said two apertures of said planar face being aligned with said first and second apertures of said valve block;

a support member having a portion thereof secured substantially adjacent the outer surface of said planar face of said facepiece opposite said valve block, with said substantially planar face of said facepiece acting as a gasket between said valve block and said support member;

said valve block having a third aperture therethrough;

an anti-suffocation valve being arranged in said third aperture; and said substantially planar face having a third aperture therethrough aligned with said third aperture of said valve block.

2. A face mask according to claim 1, comprising:

further apertures in said substantially planar face of said facepiece; and fastening means passing through said further apertures and detachably holding together said facepiece and said support member.

3. A face mask according to claim 2, wherein:

said valve block is disposed within the confines of said facepiece;

said support member comprises an exo-skeleton;

said exo-skeleton is provided with an inlet and an outlet; and said inlet communicates with said inspiratory valve to permit gas flow to said inspiratory valve, and said outlet communicates with said expiratory valve to permit gas flow from said expiratory valve.

4. A face mask according to claim 3, wherein:

a microphone assembly is removably mounted in said exo-skeleton;

said valve block has a further aperture aligned with said microphone; and said substantially planar face has a corresponding aperture aligned with said further apertures of said valve block.

5. A face mask according to claim 3, wherein:

a harness assembly for attaching said face mask to a wearer is removably mounted on said exo-skeleton.

* * * * *